United States Patent [19]

Katsuji

[11] 3,949,670

[45] Apr. 13, 1976

[54] MULTICOLOUR OFFSET PRESS

[76] Inventor: Akiyama Katsuji, 16-22, Nishi-Arai 6 chome, Adachi, Tokyo, Japan, 123

[22] Filed: Feb. 21, 1975

[21] Appl. No.: 551,679

[52] U.S. Cl. ..... 101/177; 101/183

[51] Int. Cl.[2] ..... B41F 7/10

[58] Field of Search ..... 101/174, 177, 183, 184, 101/185, 136, 137

[56] References Cited

UNITED STATES PATENTS

| | | | |
|---|---|---|---|
| 965,502 | 7/1910 | Dean | 101/183 X |
| 1,621,607 | 3/1927 | Sharpless | 101/183 |
| 3,384,011 | 5/1968 | Bolza-Schunemann | 101/177 |
| 3,516,355 | 6/1970 | Giuiuzza | 101/183 |
| 3,818,827 | 6/1974 | Johne et al. | 101/184 |

FOREIGN PATENTS OR APPLICATIONS

| | | | |
|---|---|---|---|
| 432,853 | 8/1926 | Germany | 101/137 |
| 442,647 | 4/1927 | Germany | 101/137 |

*Primary Examiner*—J. Reed Fisher
*Attorney, Agent, or Firm*—Holman & Stern

[57] ABSTRACT

A multicolor offset press includes a printing unit having two sets of plate cylinders and blanket cylinders and a common impression cylinder which bears against the blanket cylinders. The impression cylinder has a diameter which is equal to three times that of the blanket cylinders. The blanket cylinders are spaced apart relative to each other by a distance which is substantially greater than the length of their transfer surface. Where at least two printing units are interconnected, there is provided a single transfer cylinder which bears against the impression cylinders of the respective units. The transfer cylinder has the same diameter as the impression cylinders.

2 Claims, 6 Drawing Figures

MULTICOLOUR OFFSET PRESS

FIELD OF THE INVENTION

The invention relates to a multicolor offset press, and more particularly to an improvement of a multicolor offset press having a cylinder arrangement in which at least one printing unit includes two sets of plate cylinders and blanket cylinders as well as a common impression cylinder.

BACKGROUND OF THE INVENTION

The known simplest technique of accomplishing a multicolor printing is to use a tandem arrangement of a number of single color printing units which are equal in number to the number of colors desired and which are coupled together by a plurality of transfer cylinders. In such an arrangement, each of the printing units includes a plate cylinder, a blanket cylinder and an impression cylinder which are sequentially in bearing engagement. In one example, a single transfer cylinder is provided between adjacent printing units, and in another example, as many as three transfer cylinders may be provided (see FIG. 1). Where such single color printing units are used, a paper to be printed is initially fed from a paper feeder to the impression cylinder of a first printing unit and thence to the grippers thereof, and subsequently passed to the grippers of a transfer cylinder. If a plurality of transfer cylinders are provided between adjacent printing units, the paper will be successively passed to the grippers of the respective transfer cylinders before it is introduced onto the impression cylinder of a second printing unit. After passing through a plurality of printing units, the paper finally reaches the grippers of a delivery. Thus, before the printing process is completed, the paper will experience a number of passes represented as $n + T(n - 1)$ where $n$ represents the number of printing units used and $T$ the number of transfer cylinders located between adjacent printing units. It is readily seen that an increase in the number of passes results in a decrease in the registering accuracy. Where single color printing units are used, the only way to reduce the number of passes is to reduce the number of transfer cylinders provided between adjacent printing units. While it will appear that a single transfer cylinder may be used to achieve the coupling between adjacent printing units, this is not always practicable in the actual design. This is because either the single transfer cylinder must have its diameter increased greater than that of the impression cylinder (FIG. 2), or its diameter must be greater than that of both the impression and blanket cylinders (FIG. 3), but this results in an increased cost and an increased size of the entire framework. It is known that an increased diameter is required for the transfer cylinder in order to provide a certain spacing between adjacent printing units so as to facilitate a replacement of the plate on the plate cylinder, servicing of an inking system and a dampening system, and the impression throw off of the blanket cylinder.

In order to overcome such difficulty, there has been proposed a cylinder arrangement which permits a single printing unit to print in two colors. In one arrangement of this type, an impression cylinder is provided in common to two sets of plate and blanket cylinders (FIGS. 4 and 5). Each set of the plate cylinder and blanket cylinder is capable of printing in a color which is different from the color of the other set, so that a two color printing can be achieved with a single printing unit and a four color printing can be accomplished by a pair of interconnected printing units. In addition to the five cylinder arrangement mentioned above, a two color printing unit may comprise a four cylinder arrangement in which a pair of plate cylinders are engaged by a common blanket cylinder which is in turn engaged by a single impression cylinder. However, in this instance, the diameter of the impression cylinder must be reduced to one-half that of the blanket cylinder, which limits the use of such arrangement to a two color printing press. This is because a reduced diameter of the impression cylinder as compared with that of the blanket cylinder presents a difficulty in the interconnection of two printing units and also in the construction of the entire framework. A two color printing unit having the five cylinder arrangement is used not only in a two color printing press but also in a multicolor press capable of printing in four or more colors. However, in the prior art practice, the impression cylinder has the same diameter as the blanket cylinders and the plate cylinders, with the cylinder arrangement in a single printing unit being V-shaped either in vertical or horizontal position. When interconnecting a plurality of printing units, two methods are known. In a first method, transfer cylinders are provided between adjacent units as in the case of using single color printing units (FIG. 4), and in a second method, a chain conveyor having grippers is provided therebetween (FIG. 5). When the first method is employed, it will be desirable to provide a single transfer cylinder in order to reduce the number of passes, but this cannot be attained since a greater spacing is required between adjacent printing units in the cylinder arrangement of this type than in a single color printing unit. According to the second method, the chain conveyor running across the adjacent printing units would represent a single transfer cylinder, but locating a number of grippers very accurately on the chain conveyor involves a machining difficulty. In addition, a slack in the chain causes an error which must be compensated for.

Viewed from another standpoint, the known five cylinder arrangement having a common impression cylinder bearing against a pair of blanket cylinders (FIGS. 4 and 5) has another disadvantage of being susceptible to a mackle phenomenon in color since the equality of the diameter between the blanket cylinders and the impression cylinder results in inks of different colors being simultaneously applied to a paper on the impression cylinder from the respective blanket cylinders. This results from a very slight difference in the size of the two blanket cylinders and also from a differential elastic deformation of the respective blanket cylinders as a result of differential bearing pressures with the impression cylinder.

A further significant disadvantage found in the prior art, whether single color printing units or two color printing units are combined together, is the fact that the respective printing units must be independently driven from a common drive source. Although two single color printing units may sometimes be driven simultaneously, where four units are used, they must be separately driven in groups of two units. This is because several transfer cylinders or chain conveyors must be disposed between the driven parts of the respective printing units, but the transmission of the power through the parts in a sequential manner prevents the synchronization from being maintained as a result of transmission loss. If a drive shaft extending below the respective printing units is used to transmit the power to the driven parts of the respective units through suitable gearing, there can be a substantial relative play between the respective gearings, and in addition the torsional loss of the drive shaft must be taken into consideration. To avoid such difficulties, a complex gearing such as shown in Japanese Pat. Publication No. 11367/63 had to be used heretofore.

SUMMARY OF THE INVENTION

Therefore, it is an object of the invention to provide a multicolor offset press which eliminates substantially all of the disadvantages found in the conventional multicolor offset press.

It is another object of the invention to provide a multicolor offset press which includes a two color printing unit having a cylinder arrangement in which a pair of blanket cylinders bearing against a common impression cylinder can be spaced apart from each other by a distance which is substantially greater than the length of their transfer surface.

It is a further object of the invention to provide a multicolor offset press having a cylinder arrangement which permits a pair of two color printing units to be interconnected through a single transfer cylinder.

It is an additional object of the invention to provide a multicolor offset press in which a pair of printing units can be simultaneously driven by the power transmitted from the shaft of a single transfer cylinder disposed therebetween.

In accordance with the invention, there is provided a multicolor offset press including a printing unit which comprises two sets of plate cylinders and blanket cylinders and a common impression cylinder bearing against the respective blanket cylinders, and which permits the printing unit to be used either alone or in combination with a similar printing unit. In the multicolor offset press according to the invention, the impression cylinder of the printing unit has a diameter which is equal to 3 times that of the blanket cylinders, and the two blanket cylinders are disposed for abutment against the peripheral surface of the impression cylinder at predetermined points. When a pair of printing units are interconnected, a single transfer cylinder having a diameter which is equal to that of the impression cylinder of the respective units is interposed therebetween.

The above and other objects, features and advantages of the invention will become apparent as the description proceeds with reference to the attached drawings; in which

DESCRIPTION OF A PREFERRED EMBODIMENT

In the description to follow, it should be noted that while like numerals are used to designate corresponding parts in several figures for brevity of description, parts represented by like numerals may have somewhat different significance between several embodiments.

Before describing the invention, several arrangements of the prior art will be initially described in order to facilitate a better understanding of the present invention. For the convenience of description, the prior art arrangements are shown as a four color printing press as in the embodiment of the present invention. It will be appreciated that the use of one-half the total number of printing units will produce a two color printing. Conversely, by using additional printing units, it is also possible to provide a multicolor printing in excess of four colors.

Figure 1:
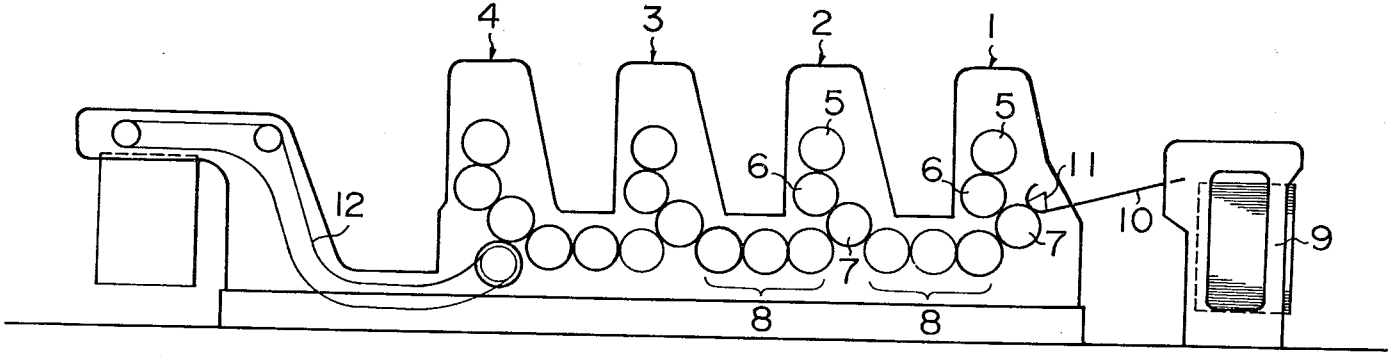
FIG. 1 PRIOR ART
FIGS. 1 to 3 are schematic side elevations of several known multicolor offset presses including a plurality of printing units each having a cylinder arrangement for printing in one color.
Figure 2:
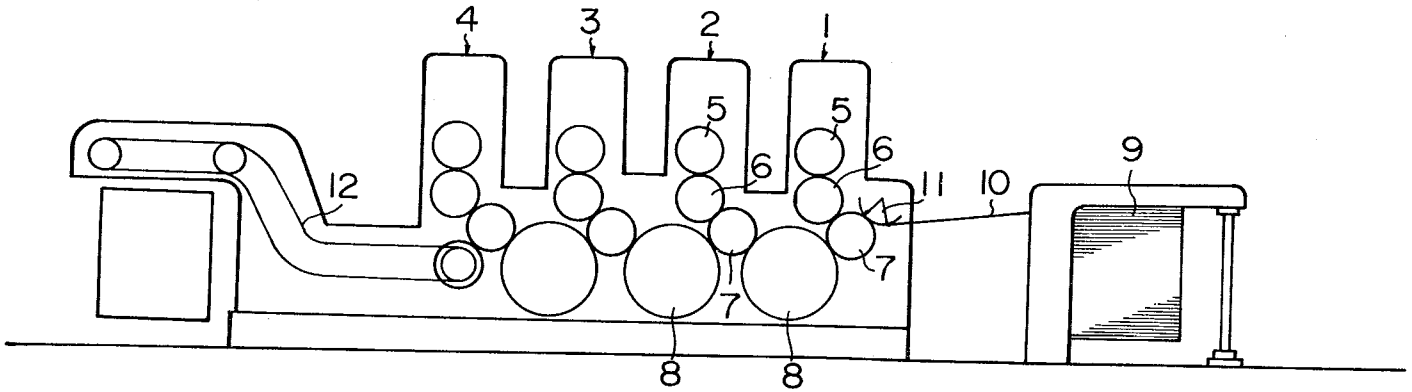
FIG. 2 PRIOR ART
Figure 3:
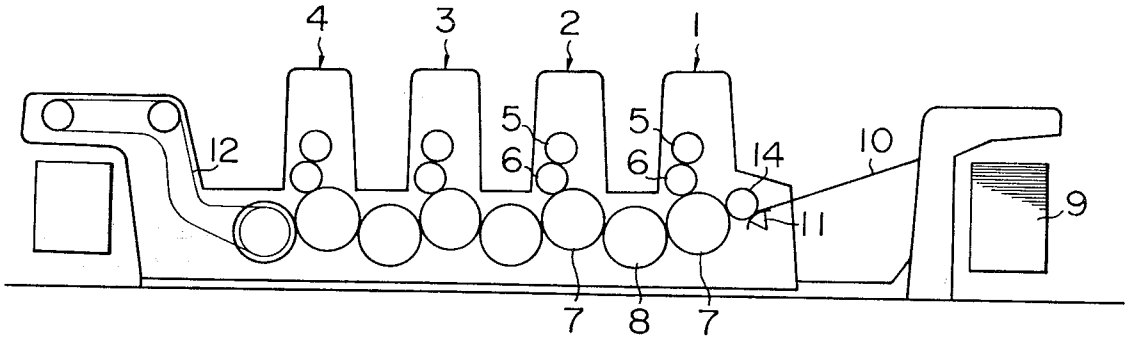
FIG. 3 PRIOR ART

In the prior art arrangements shown in FIGS. 1 to 3, four printing units 1, 2, 3 and 4 are juxtaposed, and each printing unit includes a plate cylinder 5, a blanket cylinder 6 and an impression cylinder 7. As is well known, the plate cylinder 5 is supplied with an ink from an inking roller (not shown) and conveys it to the blanket cylinder 6 formed of or wrapped with rubber, which in turn transfers the ink onto a paper on the impression cylinder 7. A suitable number of transfer cylinders 8 are disposed intermediate adjacent printing units. While not shown, it should be understood that each of the impression cylinders 7 and the transfer cylinders 8 is provided with suitable grippers for retaining the paper thereon. A paper to be printed is supplied from a stack within a container 9 through a chute 10 to the impression cylinder 7 of the first printing unit 1 as by swing gripper assembly 11. Subsequent to the printing in the first printing unit, the paper is passed over the transfer cylinders 8 to the impression cylinder 7 of the second printing unit 2. A similar process is repeated, and finally the paper is conveyed away by means of a chain conveyor assembly 12 which is provided with grippers. In the arrangement shown in FIG. 1, the plate cylinder 5, the blanket cylinder 6 and the impression cylinder 7 of each printing unit has a same diameter, and three transfer cylinders 8 are interposed between adjacent printing units, each of the transfer cylinders 8 having the same diameter as the impression cylinder 7. It will be obvious that the number of passes of the paper is very much increased in such a cylinder arrangement. In the arrangement shown in FIG. 2, the plate cylinder 5, the blacket cylinder 6 and the impression cylinder 7 of each printing unit has an equal diameter again, but in this instance a single transfer cylinder 8 having a diameter which is equal to twice that of the impression cylinder 7 is disposed intermediate adjacent printing units. It will be appreciated from the illustration that the servicing will be rendered difficult because of the small spacing between the adjacent printing units even though the diameter of the transfer cylinder 8 is as large as twice that of the impression cylinder 7. The arrangement of FIG. 3 also employs the large diameter transfer cylinder 8, and additionally employs the impression cylinder 7 of a diameter which is as large as twice that of the blanket cylinder 6, with consequent increase in the dimension of the entire framework.

Figure 4:
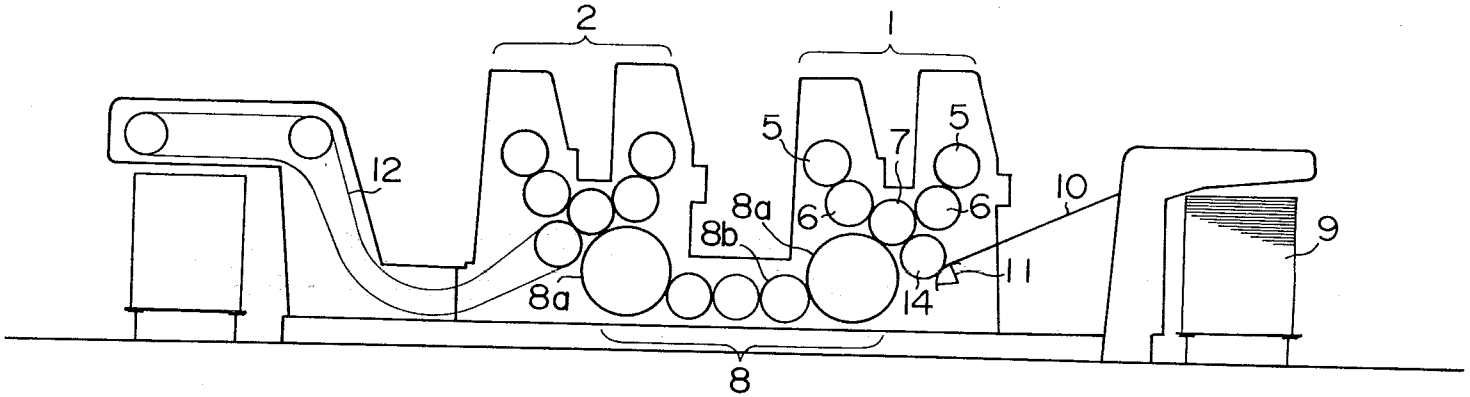
FIG. 4 PRIOR ART
FIGS. 4 and 5 are schematic side elevations of typical known multicolor offset presses including a plurality of printing units each having a cylinder arrangement for printing in two colors.
Figure 5:
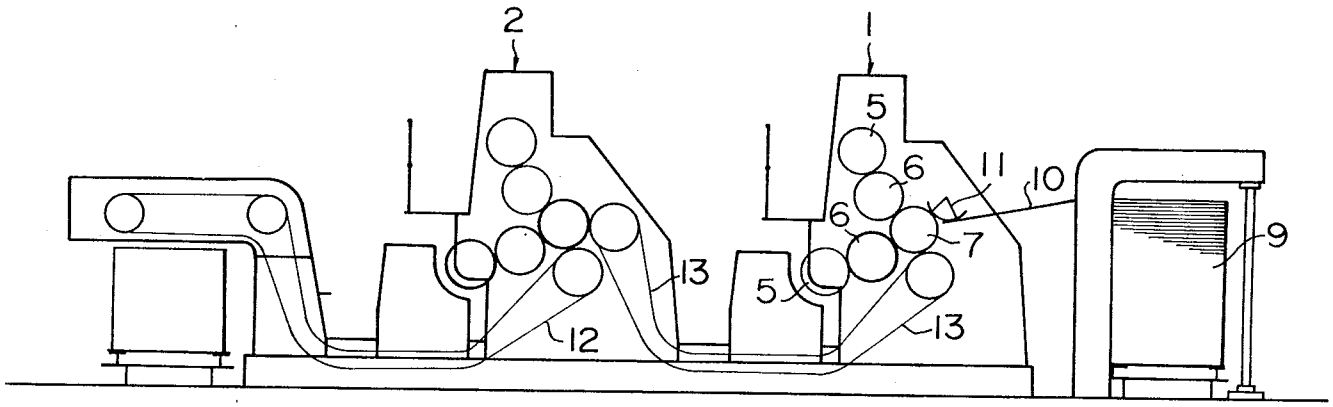
FIG. 5 PRIOR ART

In the prior art arrangement shown in FIGS. 4 and 5, a pair of printing units 1 and 2 are provided. Each of these printing units includes two sets of plate cylinders 5 and blanket cylinders 6 and a common impression cylinder 7 which bears against the both blanket cylinders 6. The respective plate cylinders 5 associated with a printing unit are supplied with inks of different colors from separate inking systems (not shown) and convey them to a paper on the common impression cylinder 7 through separate blanket cylinders 6. In either arrangement, the plate cylinders 5, the blanket cylinder 6 and the impression cylinder 7 of each printing unit have an equal diameter. The paper is passed between the adjacent printing units over a number of transfer cylinders 8 in the arrangement of FIG. 4 and in the arrangement of FIG. 5, through a transfer chain conveyor 13 having grippers which is constructed in the similar manner as the delivery chain conveyor 12. In the arrangement of FIG. 4 employing a number of transfer cylinders 8, that one of the transfer cylinders, 8*a*, which bears against the impression cylinder 7 of each printing unit is of a diameter which is twice that of the impression cylinder 7 in order to facilitate the positioning of the cylinders. Nevertheless, several transfer cylinders 8*b* having the same diameter as the blanket cylinder 6 must be provided intermediate the transfer cylinders 8*a* having an increased diameter. As a result, factors which cause a reduction in the registering accuracy are not sufficiently eliminated even though the number of passes is reduced as compared with a single color printing unit. In the arrangement of FIG. 5 using the transfer chain conveyor 13, several problems arise as mentioned previously in order for the chain conveyor 13 to feed the paper to the impression cylinder 7 of the second printing unit with an accurate timing, in contradistinction to the delivery chain conveyor 12. It will be noted that in FIG. 4, a known supply cylinder 14 is shown in connection with the swing gripper assembly 11.

While there is some difference in the cylinder arrangement within the respective printing units 1 and 2 when the arrangements of FIGS. 4 and 5 are compared, it will be understood that two blanket cylinders 6 simultaneously apply inks onto the paper on the impression cylinder 7. In such an equal diameter cylinder arrangement, it is customary that a transfer surface around the blanket cylinder 6 extends for an angle of about 270°, so that it is impossible to allow the two blanket cylinders 6 to bear against the impression cylinder 7 at points which are spaced apart by a distance greater than the length of such transfer surface. The resulting disadvantage has been described previously and will not be repeated herein.

Figure 6:
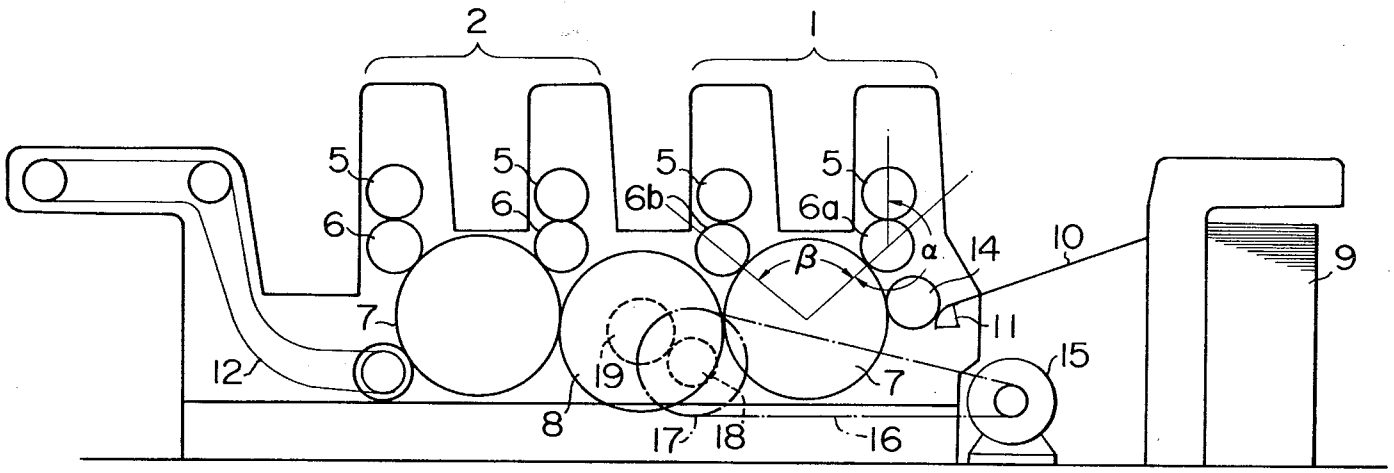
FIG. 6 is a schematic side elevation of the multicolor offset press constructed in accordance with the invention as embodied in a four color printing arrangement.

FIG. 6 shows the multicolor offset press constructed in accordance with the invention which includes means for overcoming the above mentioned disadvantages of the prior art arrangements. The embodiment shown includes a pair of printing units 1 and 2, each of which comprises two sets of plate cylinders 5 and blanket cylinders 6 as well as a common impression cylinder 7. Such a cylinder arrangement is in itself similar to those shown in FIGS. 4 and 5, but in accordance with the invention, while the plate cylinders 5 and blanket cylinders 6 are of an equal diameter, the impression cylinder 7 has a diameter which is equal to 3 times that of the blanket cylinder 6, and the two blanket cylinders 6 which bear against the common impression cylinder 7 are spaced apart from each other by a distance which is greater than the length of their transfer surface. In this connection, the impression cylinder 7 is provided, at three points which are equiangularly spaced around the circumference thereof, with conventional grippers, which are not shown for clarity of the illustration. It will be readily feasible for one skilled in the art to provide grippers around the peripheral surface of the impression cylinder 7 in this manner.

It has been mentioned before that two blanket cylinders 6 which bear against the common impression cylinder 7 are spaced apart by a distance which is greater than the length of their transfer surface. More specifically, if the length of the transfer surface of one blanket cylinder 6*a* which is substantially equal to the length of the plate cylinder 5 subtends an angle of $\alpha$, the blanket cylinder 6*a* and the other blanket cylinder 6*b* engage the common impression cylinder 7 at points which are located such that a pair of lines passing through these points and the center of the impression cylinder 7 subtend an angle of $\beta$ which is greater than the angle $\alpha$. Such a disposition is made possible by the choice of a diameter of the impression cylinder 7 which is equal to 3 times that of the blanket cylinders 6. As a consequence, the mackle phenomenon which has been pointed out in connection with the prior art is substantially completely eliminated. It is desirable that the two blanket cylinders 6 be arranged in a common plane.

When the arrangement according to the invention is applied to a two color printing press, one of the pair of printing units shown may be eliminated, but the above mentioned features of the present invention provides a maximum contribution to a multicolor printing press in which a plurality of printing units are interconnected. This is because a single transfer cylinder 8 may be disposed between adjacent impression cylinders 7 of the respective printing units when the impression cylinders 7 have a diameter which is equal to 3 times that of the blanket cylinders 6. The transfer cylinder 8 has the same diameter as the impression cylinder 7, and is provided with grippers (not shown) at positions which divide its circumference into three equal lengths, which grippers cooperate with those of the impression cylinders 7. It is desirable, though not limitative, that the impression cylinders 7 of the respective printing units be placed substantially on a single plane and the transfer cylinder 8 which is interposed therebetween be located slightly below such plane, since the impression throw off of the blanket cylinders located adjacent to the transfer cylinder 8, such as the blanket cylinders 6*a* and 6*b* of the first and second printing units, usually takes place in a direction toward the transfer cylinder 8. When the blanket cylinders 6 of the respective printing units 1, 2 are distributed in a single plane with an equal spacing therebetween, there is secured a sufficient space to permit an efficient work.

The operation of the multicolor offset press according to the invention is similar to that of a known press in that a paper to be printed is supplied from a stack within the container 9 through the chute 10 to the impression cylinder 7 of the first printing unit 1. A supply cylinder 14 is shown in connection with the swing gripper assembly 11 at the end of the chute 10, but may be replaced by other known supply means. Since three grippers are provided on the peripheral surface of the impression cylinder 7 in accordance with the invention, the supply means is operated for each gripper. Since three sheets of paper are printed during one revolution of the impression cylinder 7, the number of times the grippers are operated for a given number of printed sheets is reduced, thus minimizing the replacement of the grippers due to their abrasion which took place frequently in the prior art. The paper which has been printed in the first printing unit 1 is passed over the transfer cylinder 8 onto the impression cylinder 7 of the second printing unit. After final printing stroke, the paper is carried away by the chain conveyor 12 in the conventional manner. It will be noted that in such a printing process, the number of passes of the paper to be printed is minimized. Alternatively, as compared with the transfer chain conveyor system shown in FIG. 5 in which the number of passes is comparable to the present invention, the accumulative error caused by the passes is reduced because a transfer cylinder 8 can be machined to a greater accuracy than a chain conveyor.

The embodiment of the invention in which a pair of two color printing units 1, 2 are interconnected by a single transfer cylinder 8 provides a desirable feature that the both printing units 1, 2 can be simultaneously driven from a common drive source. In accordance with the invention, the power may be transmitted to the transfer cylinder 8, which in turn drives the impression cylinders 7 located on the opposite sides thereof simultaneously. The provision of intermeshing gears of the same diameter as the cylinders to drive adjacent cylinders is well known and hence is not shown in the drawings. Similarly, utilizing the impression cylinders 7 of the respective printing units 1, 2 to drive the associated blanket cylinders 6 and plate cylinders 5 and/or other parts is also known and hence is not shown. However, a drive source 15 is shown connected with the transfer cylinder 8 through a power transmission system, which comprises a pulley 17 across which extends a belt 16, a gear 18 which is coaxial with the pulley 17, and another gear 19 which is coaxial with the transfer cylinder 8 and meshes with the gear 18. In accordance with the invention, the various driven parts of the respective printing units 1, 2 are powered from the single transfer cylinder 8 and assume substantially symmetrical positions with respect to this drive source, so that it is readily possible to maintain a synchronous speed without the need for a special power transmission system as required in the prior art.

From the foregoing description, it will be appreciated that while the invention is most useful in a four color printing press having a pair of interconnected printing units rather than in a two color printing press which incorporates a single printing unit, the invention is in no way limited to a four color printing press.

Having described the invention, what is claimed is:

1. A multicolor offset press including at least two printing units, each of the printing units comprising two sets of plate cylinders and blanket cylinders as well as a common impression cylinder which bears against the both blanket cylinders, said impression cylinder having a diameter which is equal to 3 times that of the blanket cylinders, said blanket cylinders of a printing unit being spaced apart from each other by a distance along the circumference of the impression cylinder which is greater than the length of the transfer surface of the blanket cylinders, the press further including a transfer cylinder interposed between the printing units, said transfer cylinder bearing against the respective impression cylinder of the printing units and having a diameter which is equal to that of the impression cylinder, impression cylinder and transfer cylinder each including means located at positions on the peripheral surface thereof which divide the circumference of the cylinders into three equal lengths whereby three sheets can be printed for each revolution of the impression and transfer cylinder, said transfer cylinder being located below a plane on which the impression cylinders of the printing unit are located, the blanket cylinders of the printing unit being disposed in a single plane with an equal spacing between adjacent blanket cylinders.

2. A multicolor offset press according to claim 1, further including means for driving the transfer cylinder, and means for transmitting the drive power from the drive means to each of the impression cylinders which bear against the transfer cylinder.

* * * * *